US007388565B2

(12) United States Patent
Khurana et al.

(10) Patent No.: US 7,388,565 B2
(45) Date of Patent: Jun. 17, 2008

(54) LCD DRIVER WITH ADJUSTABLE CONTRAST

(75) Inventors: Jatin Khurana, Haryana (IN); Yvon Gourdou, Munich (DE)

(73) Assignees: STMicroelectronics Pvt. Ltd., Noida (IN); STMicroelectronics GmbH, Grasbrunn (DE)

( * ) Notice: Subject to any disclaimer, the term of this patent is extended or adjusted under 35 U.S.C. 154(b) by 546 days.

(21) Appl. No.: 11/001,656

(22) Filed: Dec. 1, 2004

(65) Prior Publication Data

US 2005/0134530 A1 Jun. 23, 2005

(30) Foreign Application Priority Data

Dec. 2, 2003 (IN) ..... 1505/2003

(51) Int. Cl.
*G09G 3/36* (2006.01)

(52) U.S. Cl. ..... 345/87; 345/99; 345/100

(58) Field of Classification Search ..... 345/87, 345/89, 99, 100, 102, 204
See application file for complete search history.

(56) References Cited

U.S. PATENT DOCUMENTS 5,596,554 A * 1/1997 Hagadorn ..... 368/82
6,075,509 A * 6/2000 Ellis et al. ..... 345/98
6,127,994 A * 10/2000 Ellis et al. ..... 345/94
6,597,119 B2 * 7/2003 Ito ..... 315/169.1
7,084,865 B2 * 8/2006 Tyrrell et al. ..... 345/211
2002/0039087 A1 * 4/2002 Inukai ..... 345/76
2003/0122753 A1 * 7/2003 Park ..... 345/87
2004/0095302 A1 * 5/2004 Tyrrell et al. ..... 345/87

* cited by examiner

*Primary Examiner*—Richard Hjerpe
*Assistant Examiner*—Kimnhung Nguyen
(74) *Attorney, Agent, or Firm*—Gardere Wynne Sewell LLP

(57) ABSTRACT

An LCD display driver provides adjustable contrast independent of multiplexing requirements by generating each COM signal in a time slot of a repeating signal frame, with each COM signal containing one or more active periods and one or more inactive periods. The relative time proportions of these periods are adjustable. Corresponding SEGMENT signals turn on/off required segments while maintaining an essentially zero DC component. The logic levels and the relative active time and inactive times of the COM and segment signals being adjustable for increasing or decreasing the RMS voltage levels across the LCD element as desired.

20 Claims, 5 Drawing Sheets

Figure1. Basic LCD Timing Diagram for a Quadruplex LCD

Figure2. LCD Timing Diagram with Active & Dead time to DECREASE the LCD Rms Voltage

Figure3. LCD Timing Diagram with Active & Dead time to INCREASE the LCD Rms Voltage

Figure4. Hardware Setup

LCD DRIVER WITH ADJUSTABLE CONTRAST

PRIORITY CLAIM

This application claims priority from Indian Application for Patent No. 1505/Del/2003 that was provisionally filed Dec. 2, 2003, and for which a complete specification was filed Mar. 22, 2004, the disclosures of both of which are hereby incorporated by reference.

BACKGROUND OF THE INVENTION

1. Technical Field of the Invention

The present invention relates to a Liquid Crystal Display (LCD) driver that provides adjustable contrast independently of the multiplexing method.

2. Description of Related Art

LIQUID CRYSTAL DISPLAYS (LCDs) are used for displaying messages. There are various methods to drive the LCD display. One method uses inbuilt hardware drivers/controllers to control the display of characters/graphics on the LCD. Such LCD modules are easier to interface but are expensive due to the inbuilt hardware drivers/controllers. Another method to drive an LCD display is through a dedicated Microcontroller which has an inbuilt hardware LCD driver to control the LCD display as well as the Contrast. Such a method is also relatively expensive.

U.S. Pat. No. 4,385,294 describes an LCD display controller in which the LCD display is controlled by means of dedicated display drive circuitry. However, this display drive circuitry fails to work if the RMS voltage output of the circuitry is less than the LCD operating voltage. This arrangement is also relatively expensive to use.

There is accordingly a need to provide an improved and cost effective system for driving an LCD display and providing adjustable contrast independently of multiplexing requirements. Preferably, this system would make use of minimal hardware and thus provide a cost effective solution.

SUMMARY OF THE INVENTION

In accordance with an embodiment of the invention, an LCD display driver provides adjustable contrast independently of multiplexing requirements. The driver comprises a COM line driver generating as many COM signals as the required multiplexing level, each COM signal being produced in a particular time slot of a repeating signal frame containing multiple time slots, each time slot corresponding to a particular COM signal, and each COM signal containing one or more active periods and one or more inactive periods, the relative time proportions of the active periods and the inactive periods being adjustable. A SEGMENT line driver generates active signals relative to the corresponding time-slot such that the required display segments are turned-on while the remaining display segments are turned off and every LCD segment experiences an AC voltage signal with an essentially zero DC component. The logic level of the SEGMENT signals and the relative active time to inactive time for the SEGMENT and COM signals is adjustable to increase or decrease the RMS voltage level across the LCD elements as desired.

The required COM and SEGMENT signals are generated at the input-output pins of an ordinary microcontroller using software means.

The bias voltage is provided by means of a resistor network across the COM signal lines while the COM signals are tristated.

The RMS voltage level is adjusted to a higher or lower level depending upon the threshold voltage of the LCD display.

The LCD driver is implemented as an ASIC.

The inactive period is provided in each time slot or at the end of each frame.

In accordance with another embodiment of the invention, a method is provided for driving an LCD display with adjustable contrast independently of multiplexing. As many COM signals as the required multiplexing level are generated, with each COM signal being produced in a particular time slot of a repeating signal frame containing multiple time slots, each time slot corresponding to a particular COM signal, and each COM signal containing one or more active periods and one or more inactive periods, the relative time proportions of the active periods and the inactive periods being adjustable. Active segment signals are supplied relative to the corresponding time-slot such that the required display segments are turned-on while the remaining display segments are turned off and every LCD segment experiences an AC voltage signal with an essentially zero like DC component. The logic level of the SEGMENT signals and the relative active time to inactive time for the SEGMENT and COM signals is adjustable to increase or decrease the RMS voltage level across the LCD elements as desired.

In accordance with another embodiment of the invention, Segment and Com signals within a control period such that during a first portion of the control period the Segment signal for display segments to be turned on has a high voltage and has a low voltage for display segments to be turned off, and the Com signal corresponding to this control period has a low voltage while other Com signals have a mid-voltage between the high and low voltages. In one implementation where a decrease in Vrms is effectuated, during a second portion of the control period all Segment and Com signals have the low voltage. In another implementation where an increase in Vrms is effectuated, during a second portion of the control period the Segment signals have the high voltage and the Com signals have the low voltage.

BRIEF DESCRIPTION OF THE DRAWINGS

A more complete understanding of the invention may be obtained by reference to the following Detailed Description in conjunction with the accompanying Drawings wherein.

DETAILED DESCRIPTION OF THE DRAWINGS

Figure 1:
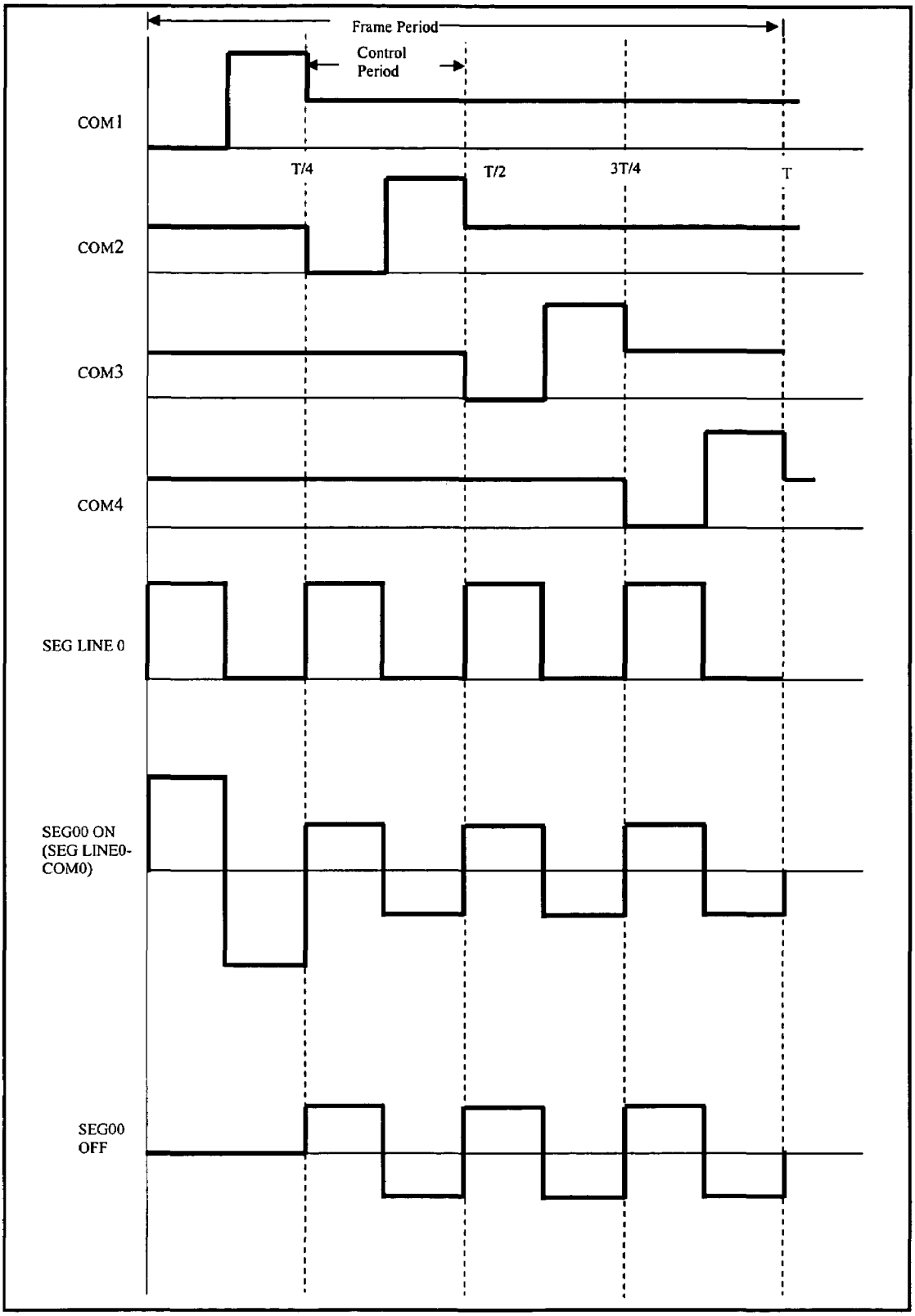
FIG. 1 shows the basic timing diagrams for a quadruplex multiplexer LCD display.

FIG. 1 shows the timing waveforms for a standard LCD display using a quadruplex multiplex method.

When a low RMS (root mean square) voltage is applied to an LCD, it is practically transparent. The LCD segment is inactive (OFF) if the RMS voltage (Vrms) is below the LCD threshold voltage and is active (ON) if the LCD RMS voltage is above the threshold voltage. The LCD threshold voltage depends on the properties of the liquid used in the LCD and the temperature. The optical contrast is defined by the difference in the transparency of an LCD segment that is ON (dark) and an LCD segment that is OFF (transparent). The optical contrast depends on the difference between the RMS voltage in the ON state (Von) and the RMS voltage in the OFF state (Voff). The larger the difference between Von and Voff, the greater is the optical contrast. The optical contrast depends as well on the difference between the on-state voltage Von and the LCD threshold voltage. If Von is below or close to the threshold voltage, the LCD is completely or almost transparent. Similarly, if Voff is close or above the threshold voltage, the LCD is completely dark.

To turn ON an LCD segment, there should be a voltage difference between the segment and common lines. With reference to FIG. 1 a description is presented of a general (basic) method to drive the Quadruplex LCD glass (four common lines). The Vrms (On) and Vrms (Off) of an LCD segment is calculated as:

$$Von(\text{rms}) = \sqrt{\frac{1}{T}\int_0^T (f(t))^2\,dt}$$

$$Von(\text{rms}) = \sqrt{\frac{1}{T}\left(\int_0^{\frac{T}{8}} (Vcc)^2\,dt + \int_{\frac{T}{8}}^{\frac{2T}{8}} (-Vcc)^2\,dt + \int_{\frac{2T}{8}}^{T} (Vcc/2)^2\,dt\right)}$$

$$Von(\text{rms}) = \sqrt{\frac{1}{T}\left((Vcc)^2 \times \frac{T}{8} + (Vcc)^2 \times \frac{T}{8} + \frac{(Vcc)^2}{4} \times \frac{6T}{8}\right)}$$

$$Von(\text{rms}) = \sqrt{\frac{2(Vcc)^2}{8} + \frac{6(Vcc)^2}{32}}$$

$$Von(\text{rms}) = \sqrt{\left(\frac{14(Vcc)^2}{32}\right)} = VON1$$

Thus, Von(rms)=0.661Vcc=VON1

$$Voff(\text{rms}) = \sqrt{\frac{1}{T}\int_0^{\frac{T}{8}} 0\,dt + \int_{\frac{T}{8}}^{\frac{2T}{8}} 0\,dt + \int_{\frac{2T}{8}}^{T} (Vcc/2)^2\,dt}$$

$$Voff(\text{rms}) = \sqrt{\left(\frac{6(Vcc)^2}{32}\right)} = VOFF1$$

Thus, Voff(rms)=0.43 Vcc=VOFF1

Figure 2:
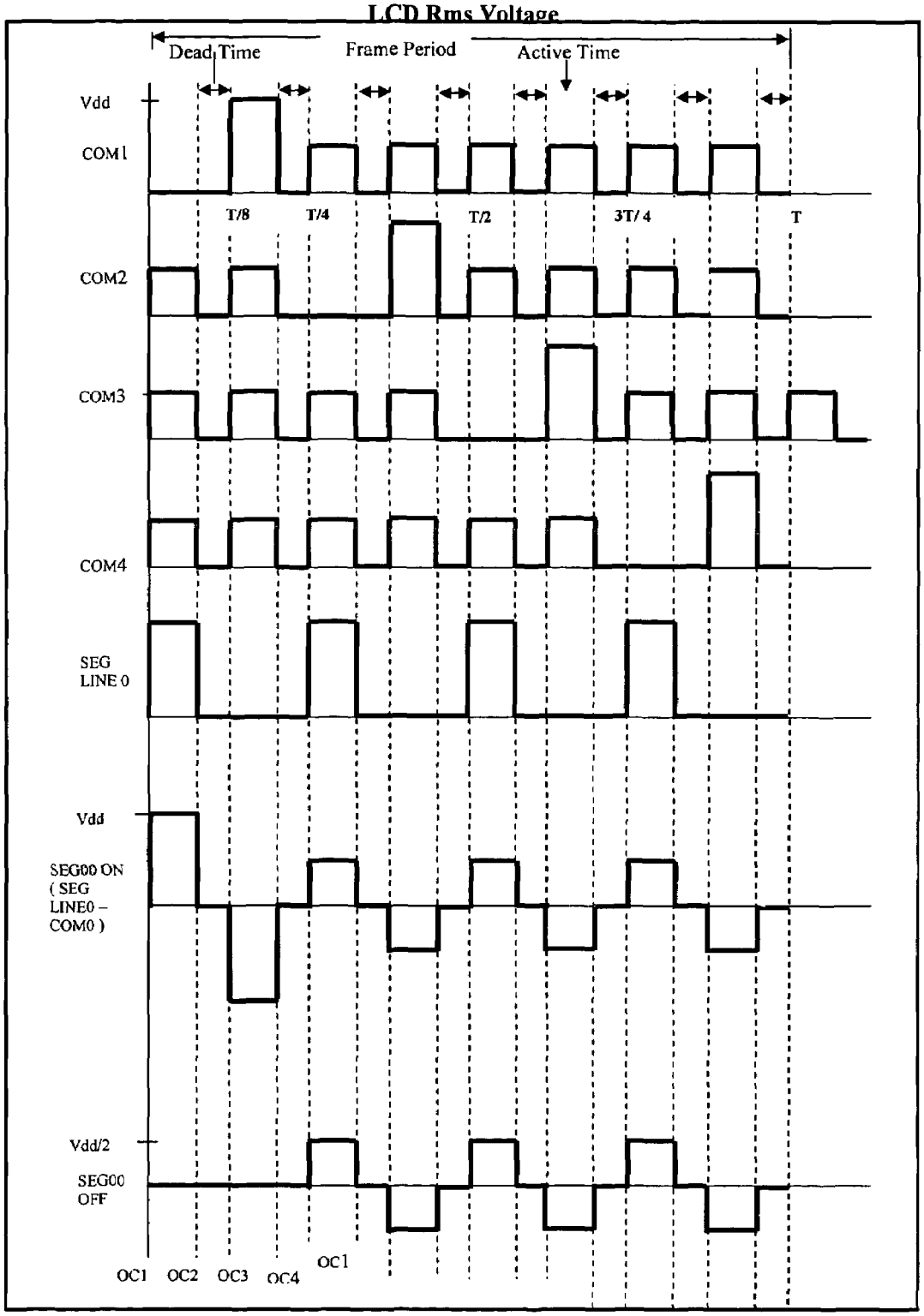
FIG. 2 shows the timing diagram for a quadruplex LCD display driver according to this invention, in which the LCD voltage is decreased to adapt the RMS output voltage to low threshold voltage LCD display.
Figure 3:
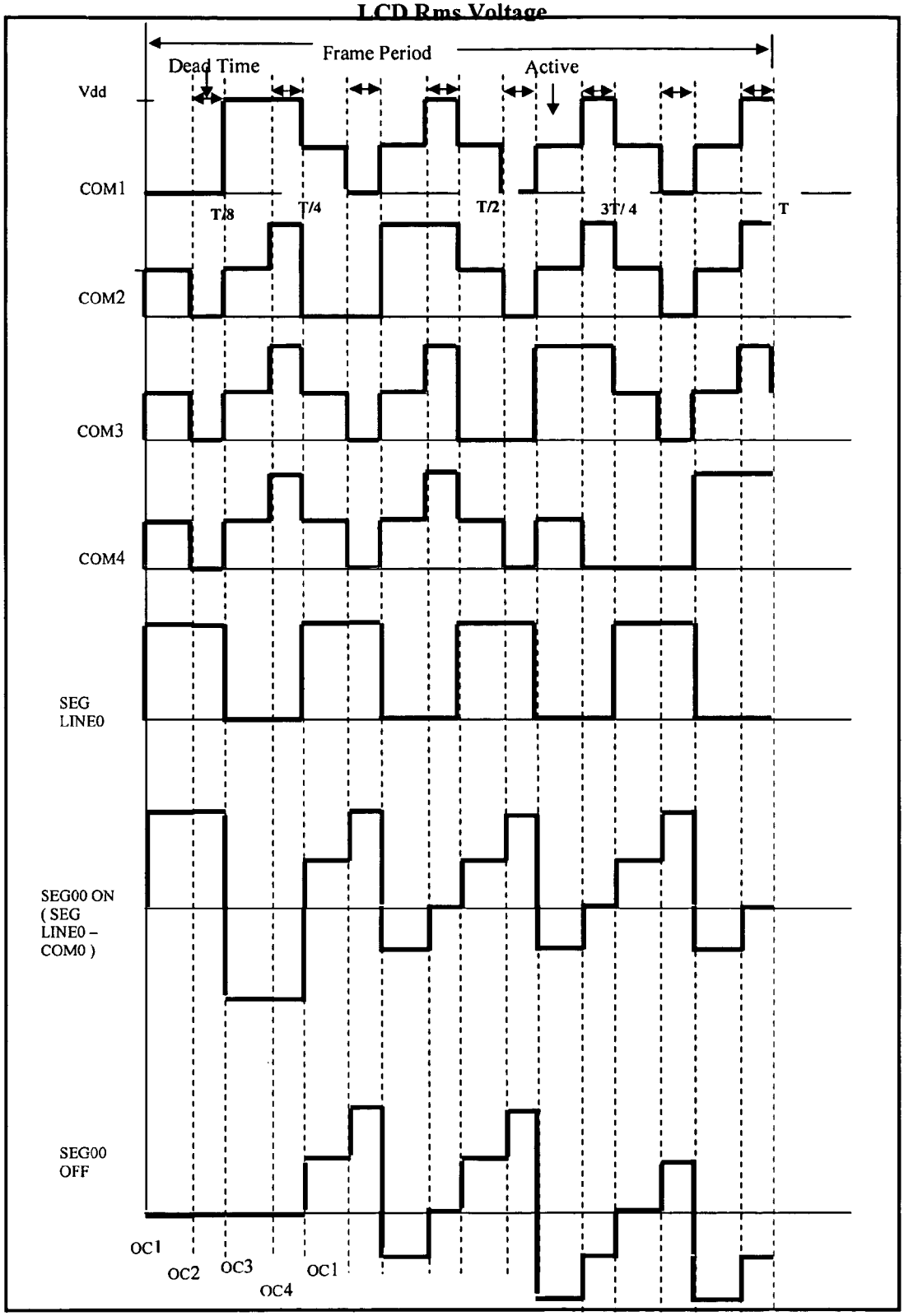
FIG. 3 shows the timing diagram for a quadruplex LCD display driver according to this invention, in which the LCD voltage is increased to adapt to high threshold voltage LCD display.

On the other hand, FIGS. 2 and 3 show the timing diagrams for a similar quadruplex LCD display driven according to embodiments of the present invention.

Contrast is controlled by tuning the RMS voltage of the LCD segment RMS voltage close to the LCD threshold voltage. The RMS voltage calculated above can be controlled by dividing the LCD driving time (control period) into two parts:

1. Active Time, and
2. Dead Time

The LCD driving waveforms are generated by using a software algorithm. During the Active time, the segment lines and COM lines are used to drive the LCD. During the Dead time, the Segment and COM lines are used to control the LCD RMS voltage. The LCD RMS voltage is controlled by varying the timing of the dead phase as shown in the LCD timing diagrams of FIGS. 2 and 3. Thus, LCD RMS voltage can be adjusted to the optimal value depending upon the operating voltage of the LCD used and the temperature.

The dead time can be used to decrease Vrms as well as to increase it (on a controller with a small supply voltage). The dead time is a voltage compensation time to regulate the rms voltage up and down. The dead time control technique is independent of the LCD multiplexing method (Duplex, Quadruplex . . . ) used as well as the bias voltage technique (½ bias, ⅓ bias . . . ) used. Dead time can be implemented after each "control period" or after each end of frame depending up on quality of the LCD and frequency of the frame to avoid a flickering effect on the LCD. The Controller of the LCD pattern and Dead time could be a microcontroller or any kind of ASIC.

Each frame period consists of four control periods (for quadruplex LCD), with one control period per COM line. With reference to FIG. 1 again, each COM line generates its waveform during its corresponding control period, e.g., COM1 line during (0-T/4). During other control periods a COM line remains at level Vdd/2. As mentioned above, each control period consists of two parts:

1. Active time, and
2. Dead time

During a first portion of a control period (OC1), voltage Vdd is applied for the segments which have to be turned ON and 0 for the segments which have to be turned OFF. The COM line which corresponds to this control period is set to low level. Other COM lines are set to level Vdd/2.

During a next portion of the control period (OC2), all segments and COM lines are inactive (set to low level) if it is desired to decrease the Vrms (FIG. 2) and COM lines are set low and segment lines are set high if is desired to increase the Vrms (FIG. 3).

During a next portion of the control period (OC3), the Segment Lines are supplied with voltage levels which are inverted to the one applied during OC1. The COM line which corresponds to this control period is set to high level. Other COM lines are set to level Vdd/2.

During a last portion of the control period (OC4), all segments and COM lines are inactive (set to low level) if it is desired to decrease the Vrms (FIG. 2) and the COM lines are set high and segments are set low if it is desired to increase the Vrms (FIG. 3).

Let the frame Period=$T+xT$

Wherein:

T=Active Time xT=Dead Time x is a proportion of the dead time

Vx=Segment Voltage during the dead time

Then:

$$Von(\text{rms}) = \sqrt{\frac{1}{T+xT}\int_0^{T+xT}(f(t))^2\,dt}$$

$$Von(\text{rms}) = \sqrt{\frac{1}{T+xT}\left(\int_0^{\frac{T}{8}}(Vcc)^2\,dt + \int_{\frac{T}{8}}^{\frac{2T}{8}}(-Vcc)^2\,dt + \int_{\frac{2T}{8}}^{T}(Vcc/2)^2\,dt + \int_0^{\frac{xT}{8}}(Vx^2\,dt)\cdot 8\right)}$$

$$Von(\text{rms}) = \sqrt{\frac{1}{T(1+x)}(Vcc)^2\cdot\frac{T}{8} + (Vcc)^2\cdot\frac{T}{8} + \frac{(Vcc)^2}{4}\cdot\frac{6T}{8} + \left(Vx^2\cdot\frac{xT}{8}\cdot 8\right)}$$

$$Von(\text{rms}) = \sqrt{\frac{1}{1+x}\left(\frac{14(Vcc)^2}{32} + \left(Vx^2\cdot\frac{x}{8}\cdot 3\right) + \left(Vx^2\cdot\frac{x}{8}\cdot 5\right)\right)}$$

Since Vx=0 (in case of decrease of Rms Voltage, see, FIG. 2), then putting Vx=0, in the above equation gives:

$$Vonx = \sqrt{\frac{1}{1+x}\left(\frac{14(Vcc)^2}{32}\right)}$$

$$Vonx = \sqrt{\frac{1}{1+x}}\,Von1$$

(for a decrease of Vrms).

In case of an increase of Rms voltage, Vx=0 for three dead periods and Vx=+/−Vdd for five dead periods (see, FIG. 3). So, putting the value for Vx gives:

$$Vonx = \sqrt{\frac{(7+10x)}{7(1+x))}}\,Von1$$

(for an increase of Vrms).

Turning next to Voff:

$$Voff(\text{rms}) = \sqrt{\frac{1}{T+xT}\int_0^{\frac{T}{8}}0\,dt + \int_{\frac{T}{8}}^{\frac{2T}{8}}0\,dt + \int_{\frac{2T}{8}}^{T}\frac{Vcc^2}{2}\,dt + \int_0^{\frac{xT}{8}}(Vx^2\,dt)\cdot 8}$$

$$Voff(\text{rms}) = \sqrt{\frac{1}{1+x}\left(\frac{6Vcc^2}{32} + \left(Vx^2\cdot\frac{x}{8}\cdot 3\right) + \left(Vx^2\cdot\frac{x}{8}\cdot 5\right)\right)}$$

Since Vx=0 (in case of a decrease of rms voltage, see, FIG. 2), then:

$$Voffx = \sqrt{\frac{1}{1+x}}\,Voff1$$

(for a decrease of Vrms).

In case of an increase of Rms voltage, Vx=0 for five dead periods and Vx=+/−Vcc for three dead periods (see, FIG. 3). Putting the value for Vx gives:

$$Voffx = \sqrt{\frac{(1+2x)}{(1+x)}}\,Voff1$$

(for an increase of Vrms).

Figure 4:
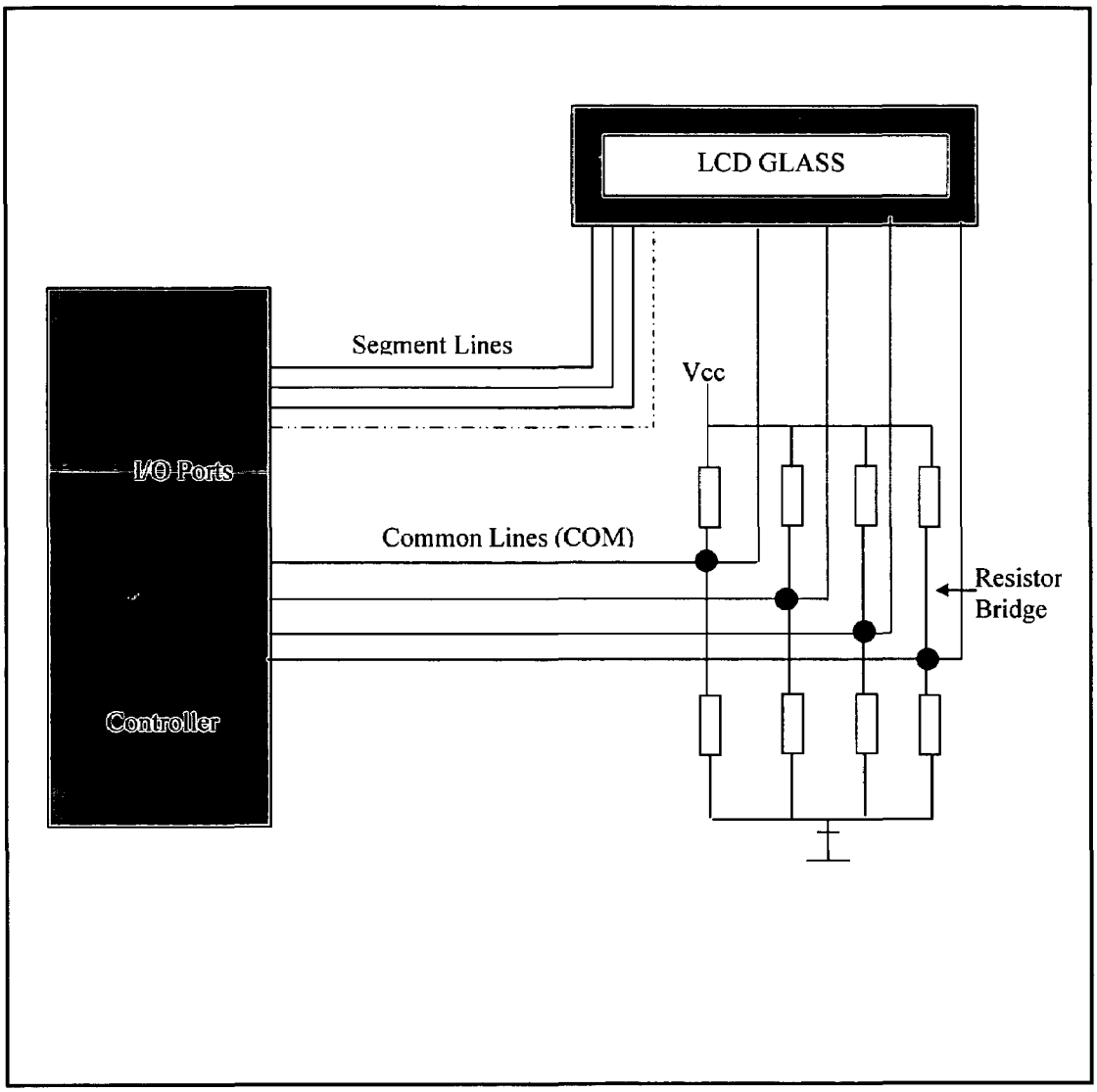
FIG. 4 shows an implementation using a standard microcontroller.

FIG. 4 shows an implementation of an embodiment of the invention using a standard microcontroller.

LCD segment RMS voltage is controlled by controlling the timing for the waveforms driving the LCD segment and common lines. These controlled LCD driving waveforms are generated by using software driver.

An external two resistor bridge (per common line) is connected externally to the MCU I/O ports which are used for driving the LCD common lines. D.C. power supply of Vdd or Vcc is used for driving all the components of the device.

The LCD Timing is generated by using the timer interrupts (wherein a timer peripheral is available inside the microcontroller).

Active time starts after timer interrupt1 and dead time starts after timer interrupt2. A total of sixteen interrupts are generated in each frame period with four interrupts per control period. There are four events, i.e., OC1, OC2, OC3, and OC4, in each control period. Timing for OC1, OC3 is the same, and timing for OC2, OC4 is the same.

The Vdd/2 level is generated by the externally connected resistor bridges.

Figure 5:
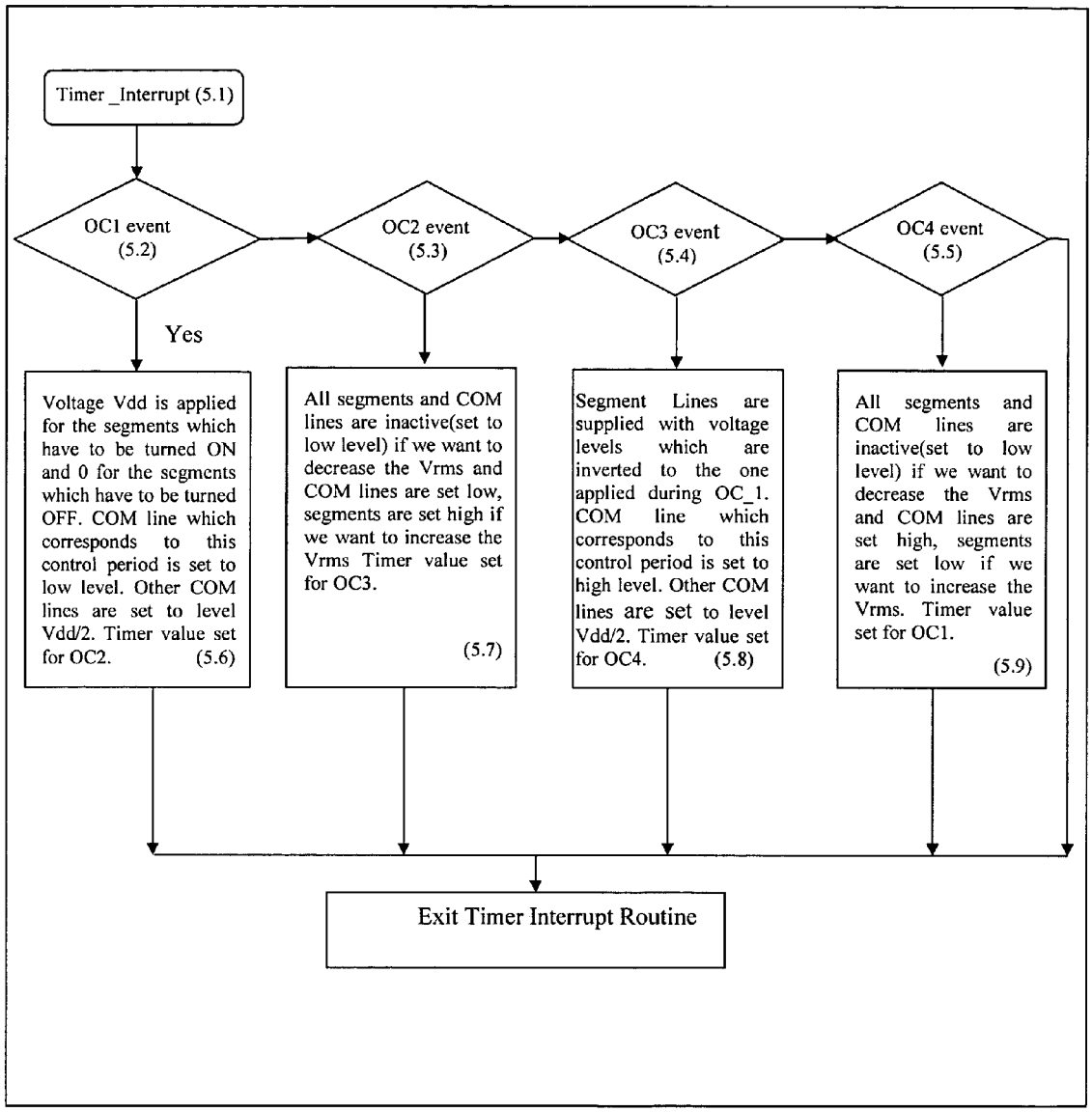
FIG. 5 shows a flowchart of the software for the implementation of FIG. 4.

FIG. 5 shows the flowchart of the software or algorithm used for the microcomputer implementation of FIG. 4. Timer interrupt (5.1) triggers an OC1 event (5.2) that applies supply voltage Vdd for segments to be turned on and 0V for segment to be turned off (5.6) while the COM line for the selected period is set to low and other COM lines are tristated. The timer is then reinitialized.

At the next timer interrupt (5.1), an event OC2 is triggered (5.3). All segments and COM lines are set to 0V if a Vrms is to be decreased and segment are set high and COM lines low if Vrms is to be increased (5.7). The timer is then reinitialized.

At the next timer interrupt event (5.1), an event OC3 is triggered (5.4). Segment lines are supplied levels that are inverted with respect to those supplied during OC1. The COM line corresponding to these time slots set high, other COM lines are tristated (5.8). The timer is then reinitialized.

The next timer interrupt (5.1) triggers the OC4 event (5.5). All segment and COM lines are set low if Vrms is to be decreased. COM lines are set high and segments are set low if Vrms is to be increased (5.9). The timer is the reinitialized.

The entire sequence is repeated continuously so that the microcontroller cycles through each of the events 5.2-5.5 for each control period.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. An LCD display driver providing adjustable contrast independently of multiplexing requirements, comprising:

a COM line driver generating as many COM signals as are required by a multiplexing level, each COM signal being produced in a particular time slot of a repeating signal frame containing multiple time slots, each time slot corresponding to a particular COM signal, and each COM signal containing one or more active periods and one or more inactive periods, the relative time proportions of the active periods and the inactive periods being adjustable, and a SEGMENT line driver generating active signals relative to a corresponding time-slot such that required display segments are turned-on while remaining display segments are turned off and every LCD segment experiences an AC voltage signal with an essentially zero DC component, wherein the logic level of the SEGMENT signals and the relative active time to inactive time for the SEGMENT and COM signals is adjustable to increase or decrease a root mean square (RMS) voltage level across the LCD elements as desired.

2. The LCD driver as in claim 1, wherein the required COM and SEGMENT signals are generated at the input-output pins of an ordinary microcontroller using software means.

3. The LCD driver as in claim 1, wherein a bias voltage is provided by means of a resistor network across the COM signal lines while the COM signals are tristated.

4. The LCD driver as in claim 1 wherein the RMS voltage level is adjusted to a higher or lower level depending upon the threshold voltage of the LCD display.

5. The LCD driver as in claim 1 wherein the LCD driver is implemented as an ASIC.

6. The LCD driver as in claim 1 wherein the inactive period is provided in each time slot.

7. The LCD driver as in claim 1 wherein the inactive period is provided at the end of each frame.

8. A method for driving an LCD display with adjustable contrast independently of multiplexing requirements comprising the steps of:

generating as many COM signals as are required by a multiplexing level, each COM signal being produced in a particular time slot of a repeating signal frame containing multiple time slots, each time slot corresponding to a particular COM signal, and each COM signal containing one or more active periods and one or more inactive periods, the relative time proportions of the active periods and the inactive periods being adjustable, and supplying active segment signals relative to a corresponding time-slot such that required display segments are turned-on while remaining display segments are turned off and every LCD segment experiences an AC voltage signal with an essentially zero DC component, adjusting a logic level of the SEGMENT signals and the relative active time to inactive time for the SEGMENT and COM signals to increase or decrease the root mean square (RMS) voltage level across the LCD elements as desired.

9. The method as in claim 8 wherein the steps are controlled using a standard microcontroller.

10. The method as in claim 8 wherein a biasing voltage is provided by using a resistor network across the COM signal line.

11. An LCD display driver, comprising:

a circuit to generate Segment and Com signals within a control period such that:

during a first portion of the control period the Segment signal for display segments to be turned on has a high voltage and has a low voltage for display segments to be turned off, and the Com signal corresponding to this control period has a low voltage while other Com signals during that same first portion of the control period have a mid-voltage between the high and low voltages; and during a second portion of the control period all Segment and Com signals change to the low voltage so as to effectuate a decrease in root mean square voltage (Vrms).

12. The driver of claim 11 wherein the circuit further generates the Segment and Com signals within the control period such that:

during a third portion of the control period the Segment signals have opposite voltages to those of the first portion and the Com signal corresponding to this control period has a high voltage while other Com signals have the mid-voltage.

13. The driver of claim 12 wherein the circuit further generates the Segment and Com signals within the control period such that:

during a fourth portion of the control period all Segment and Com signals have a low voltage so as to effectuate a decrease in Vrms.

14. The driver of claim 13 wherein the first through fourth portions occur consecutively within the control period.

15. The driver of claim 11 wherein the control period repeats with a different one of the Com signals corresponding to each control period.

16. An LCD display driver, comprising:

a circuit to generate Segment and Com signals within a control period such that:

during a first portion of the control period the Segment signal for display segments to be turned on has a high voltage and has a low voltage for display segments to be turned off, and the Com signal corresponding to this control period has a low voltage while other Com signals during that same first portion of the control period have a mid-voltage between the high and low voltages; and during a second portion of the control period the Segment signals remain at the high voltage and the Com signals change to the low voltage so as to effectuate an increase in root mean square voltage (Vrms).

17. The driver of claim 16 wherein the circuit further generates the Segment and Com signals within the control period such that:

during a third portion of the control period the Segment signals have opposite voltages to those of the first portion and the Com signal corresponding to this control period has a high voltage while other Com signals have the mid-voltage.

18. The driver of claim 17 wherein the circuit further generates the Segment and Com signals within the control period such that:

during a fourth portion of the control period the Segment signals have the low voltage and the Com signals have the high voltage so as to effectuate an increase in Vrms.

19. The driver of claim 18 wherein the first through fourth portions occur consecutively within the control period.

20. The driver of claim 16 wherein the control period repeats with a different one of the Com signals corresponding to each control period.

* * * * *